US009362076B2

(12) United States Patent
Song

(10) Patent No.: US 9,362,076 B2
(45) Date of Patent: Jun. 7, 2016

(54) TRIP DEVICE OF MOLDED CASE CIRCUIT BREAKER USING A STAIR TYPE HANGER

(71) Applicant: LSIS CO., LTD., Anyang-si, Gyeonggi-do (KR)

(72) Inventor: Su Yang Song, Seoul (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/477,365

(22) Filed: Sep. 4, 2014

(65) Prior Publication Data

US 2015/0213988 A1 Jul. 30, 2015

(30) Foreign Application Priority Data

Jan. 28, 2014 (KR) ..... 10-2014-0010697

(51) Int. Cl.

| | |
|---|---|
| ***H01H 83/00*** | (2006.01) |
| ***H01H 73/02*** | (2006.01) |
| ***H01H 71/12*** | (2006.01) |
| ***H01H 71/40*** | (2006.01) |
| ***H01H 71/50*** | (2006.01) |
| ***H01H 73/50*** | (2006.01) |
| *H01H 71/16* | (2006.01) |
| *H01H 71/52* | (2006.01) |

(52) U.S. Cl.

CPC ..... *H01H 71/12* (2013.01); *H01H 71/40* (2013.01); *H01H 71/505* (2013.01); *H01H 73/50* (2013.01); *H01H 71/16* (2013.01); *H01H 71/52* (2013.01)

(58) Field of Classification Search

CPC ..... H01H 71/40; H01H 71/12; H01H 73/50; H01H 71/505; H01H 71/16; H01H 71/52

USPC ..... 335/21, 167, 172

See application file for complete search history.

(56) References Cited

U.S. PATENT DOCUMENTS

| | | | | |
|---|---|---|---|---|
| 4,888,570 | A | 12/1989 | Toda | |
| 6,236,294 | B1 * | 5/2001 | Zindler | H01H 71/52 335/167 |
| 2009/0039988 | A1 * | 2/2009 | Song | H01H 71/501 335/21 |

FOREIGN PATENT DOCUMENTS

| | | |
|---|---|---|
| CN | 101923987 | 6/2013 |
| JP | 05-081996 | 4/1993 |
| JP | 06-290697 | 10/1994 |
| KR | 20-1999-0031458 | 7/1999 |
| KR | 20-0218816 | 4/2001 |
| KR | 20-0220198 | 5/2001 |
| KR | 10-2006-0030971 | 4/2006 |
| KR | 10-2006-0035193 | 4/2006 |
| KR | 10-2010-0052328 | 5/2010 |
| KR | 20-2011-0005111 | 5/2011 |

OTHER PUBLICATIONS

European Patent Office Application Serial No. 14188762.0, Search Report dated Jun. 22, 2015, 9 pages.

* cited by examiner

*Primary Examiner* — Bernard Rojas

(74) *Attorney, Agent, or Firm* — Lee Hong Degerman Kang & Waimey; Jonathan Kang; Jeffrey Lotspeich

(57) ABSTRACT

Disclosed is a trip device of a molded case circuit breaker. The trip device includes a shooter configured to include a body and a rotating shaft which passes through the body, a double torsion spring coupled to both sides of the rotating shaft and configured to provide an elastic restoring force to enable the shooter to rotate, and a crossbar configured to include a hanger that contacts the hanging plate and limits a movement of the shooter. A hanging plate is provided at a lower portion of the body, and a hitting plate is provided at an upper portion of the body.

6 Claims, 11 Drawing Sheets

TRIP DEVICE OF MOLDED CASE CIRCUIT BREAKER USING A STAIR TYPE HANGER

CROSS-REFERENCE TO RELATED APPLICATION

Pursuant to 35 U.S.C. §119(a), this application claims the benefit of earlier filing date and right of priority to Korean Application No. 10-2014-0010697, filed on Jan. 28, 2014, the contents of which are all hereby incorporated by reference herein in its entirety.

BACKGROUND OF THE DISCLOSURE

1. Field of the Disclosure

The present disclosure relates to a trip device of a molded case circuit breaker, and particularly, to a shooter and a crossbar of a molded case circuit breaker.

2. Background of the Disclosure

Generally, a molded case circuit breaker is an electronic device that is provided in a partial region of a power system, and when an abnormal current or overload occurs in electricity, breaks a circuit to protect the circuit and a load device. In the molded case circuit breaker, a circuit is automatically broken by a trip device, and a breaking operation is performed by manually manipulating a handle to an OFF position.

A trip operation of the molded case circuit breaker is described in detail in a trip device of a molded case circuit breaker disclosed in Korean Utility Registration NO. 20-0220198. A trip operation will be briefly summarized with reference to FIG. 1 in the prior art reference.

When an overcurrent occurs on a line, a bimetal 25 is bent to rotate a crossbar 18, a magnetic force is induced to a fixed core 15 which is provided on the line, and a moving core 16 is attracted to the fixed core 15, whereby an end of the moving core 16 hits and rotates the crossbar 18.

The crossbar 18 rotates to release a hanged state of a shooter 20 which is hanged on the crossbar 18. At this time, the shooter 20 rotates with respect to a hinge part 20*a* with an elastic restoring force of a compressed spring 21, and hits a nail 22 of a mechanism part.

As the nail 22 rotates, a latch holder 24 bound by the nail 22 is released to rotate, a latch 3 engaged with the latch holder 24 rotates, and a lower link 6 and an upper link 4 connected to the latch 3 interoperate with each other to rotate a shaft 8. As the shaft 8 rotates, a movable contactor 10 is detached from a fixed contactor 14, and thus, a flow of a current between a load and a power source is blocked.

In order to re-close the circuit breaker to an electricity conducting state, the circuit breaker is reset by rotating a handle 1 in a closing direction. When the circuit breaker is reset, an end of the handle 1 pushes an inclined surface of the shooter 20, and thus, the shooter 20 rotates with respect to a hinge shaft 20*a* with a pushing force, and is hanged on the crossbar 18, whereby the circuit breaker is restored to a before-trip state.

The trip device has an action, based on binding and release between a vertical type crossbar and a horizontal type shooter, and an elastic force of a compression spring. Examples of the trip device include a trip device of a molded case circuit breaker disclosed in Korean Utility Registration NO. 20-0218816 and a trip device of a molded case circuit breaker disclosed in Korean Utility Registration NO. 20-0220198.

Unlike such a method, a trip device has been developed in which a crossbar and a shooter are provided in the same direction, and a torsion spring is applied, for increasing an efficiency of a space and performing a stable operation. FIG. 1 illustrates some elements of the trip device using the method. An operation of the trip device will be in more detail with reference to FIG. 1.

A shooter 1 is assembled with a shooter rotating groove 3 of a trip device case 2. In this case, a single torsion spring 4 is assembled with a central shaft 1*a* of the shooter 1, and enables the shooter 1 to rotate. A crossbar 5 holds the shooter 1 so as to prevent the shooter 1 from springing forth. In detail, a hanging plate 1*b* of the shooter 1 is bound by a hanger 5*a* of the crossbar 5. The shooter 1 has a force, which is used to move frontward with an elastic restoring force of the single torsion spring 4, in a state where the shooter 1 is bound to the crossbar 5.

When the crossbar 5 rotates by performing a trip operation and thus a binding force applied to the shooter 1 is released, the shooter 1 rotates forward with the elastic restoring force of the single torsion spring 4, and hits a nail (not shown).

In this case, the elastic restoring force of the single torsion spring 4 is applied to a supporting part 1*c* which is provided at one side of the shooter 1, and thus, when the shooter 1 rotates, torsion occurs between the trip device case 2 and the shooter 1. The torsion cannot provide a certain force when the hanging plate 1*b* of the shooter 1 and the hanger 5*a* of the crossbar 5 operate, and for this reason, the crossbar 5 and the shooter 1 cannot stably operate, and the scattering of load increases.

SUMMARY OF THE DISCLOSURE

Therefore, an aspect of the detailed description is to provide a trip device of a molded case circuit breaker in which a shooter and a crossbar operate consistently.

To achieve these and other advantages and in accordance with the purpose of this specification, as embodied and broadly described herein, a trip device of a molded case circuit breaker includes: a shooter configured to include a body and a rotating shaft which passes through the body, wherein a hanging plate is provided at a lower portion of the body, and a hitting plate is provided at an upper portion of the body; a double torsion spring coupled to both sides of the rotating shaft, and configured to provide an elastic restoring force to enable the shooter to rotate; and a crossbar configured to include a hanger that contacts the hanging plate and limits a movement of the shooter.

The hanger may be formed in a stair type, and comprises a first hanging part and a second hanging part.

An upper portion of a receiving part of a trip device case, into which the rotating shaft is inserted, may be opened.

A portion of the receiving part of the trip device case may have an inclined surface.

In a length by which the rotating shaft protrudes from the body, one side of the rotating shaft may be formed longer than the other side.

A plurality of coupling parts may be respectively provided at both ends of the rotating shaft, and may have a less diameter than a diameter of a central portion of rotating shaft.

An asymmetric groove with one portion opened may be formed at one side of a lower portion of the body.

In the trip device of the molded case circuit breaker according to an embodiment of the present invention, the shooter and the crossbar operate consistently.

Moreover, an efficiency of a space is enhanced by the shooter and the crossbar which are provided in the same direction.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
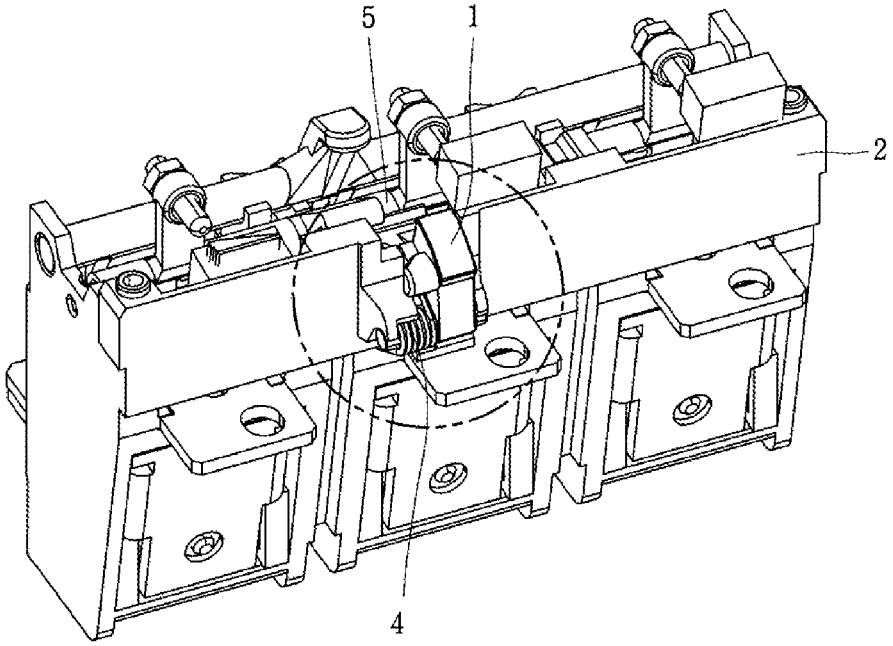
FIG. 1 PRIOR ART
FIG. 1 illustrates some elements of a related art trip device of a molded case circuit breaker.
Figure 2:
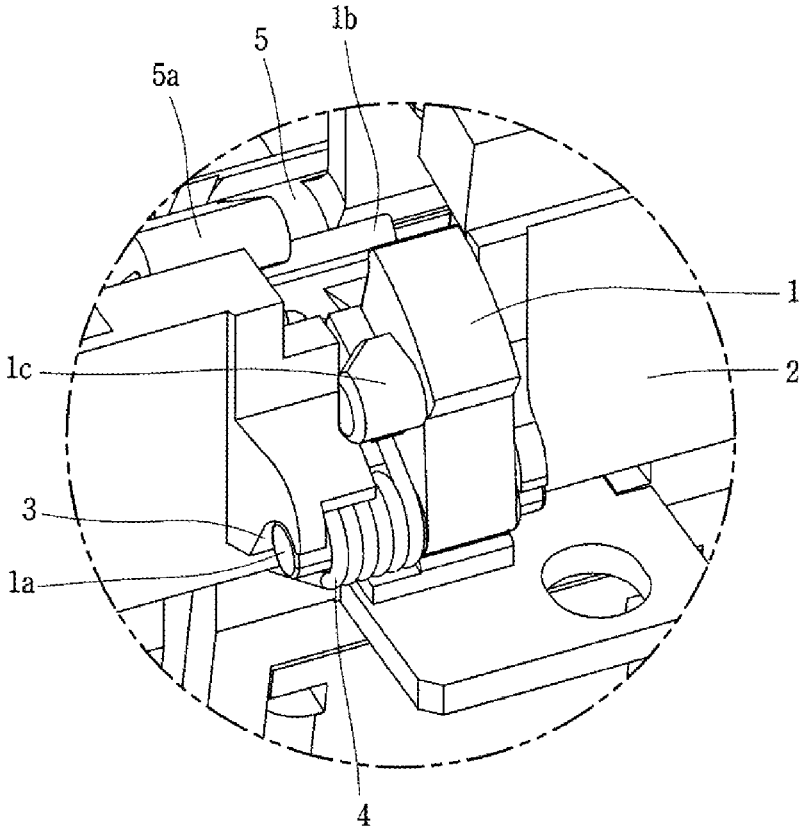
FIG. 2 PRIOR ART
FIG. 2 is a partial detailed view of FIG. 1.
Figure 3:
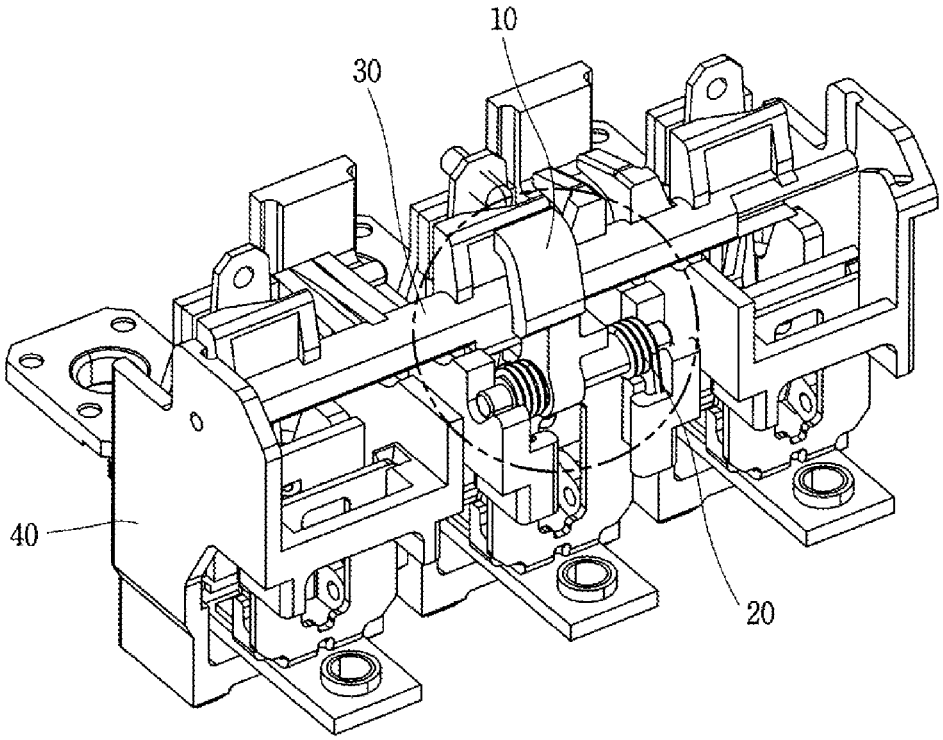
FIG. 3 is a perspective view of a trip device of a molded case circuit breaker according to an embodiment of the present invention.
Figure 4:
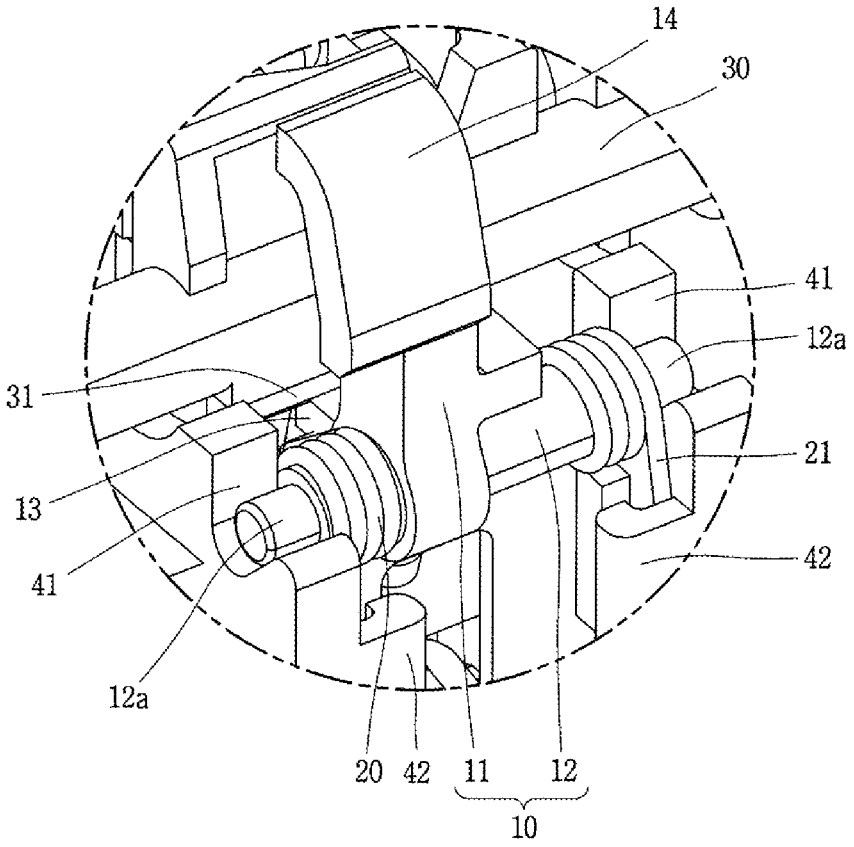
FIG. 4 is a partial detailed view of FIG. 3.
Figure 5A:
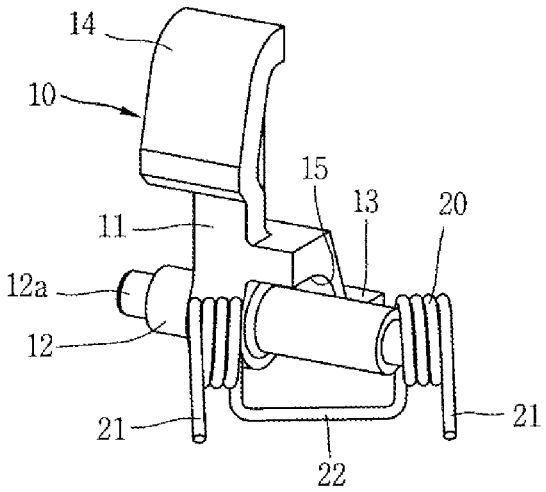
FIGS. 5*a*, 5*b* and 5*c* are views illustrating a process of assembling a shooter and a double torsion spring, in the trip device of the molded case circuit breaker according to an embodiment of the present invention.
Figure 5B:
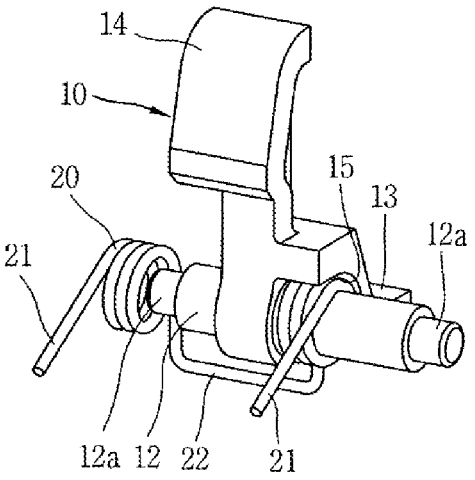
Figure 5C:
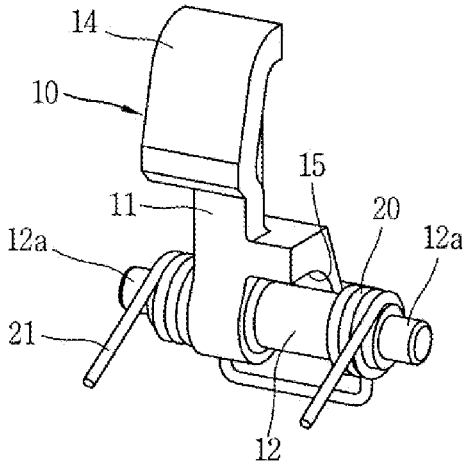
Figure 6A:
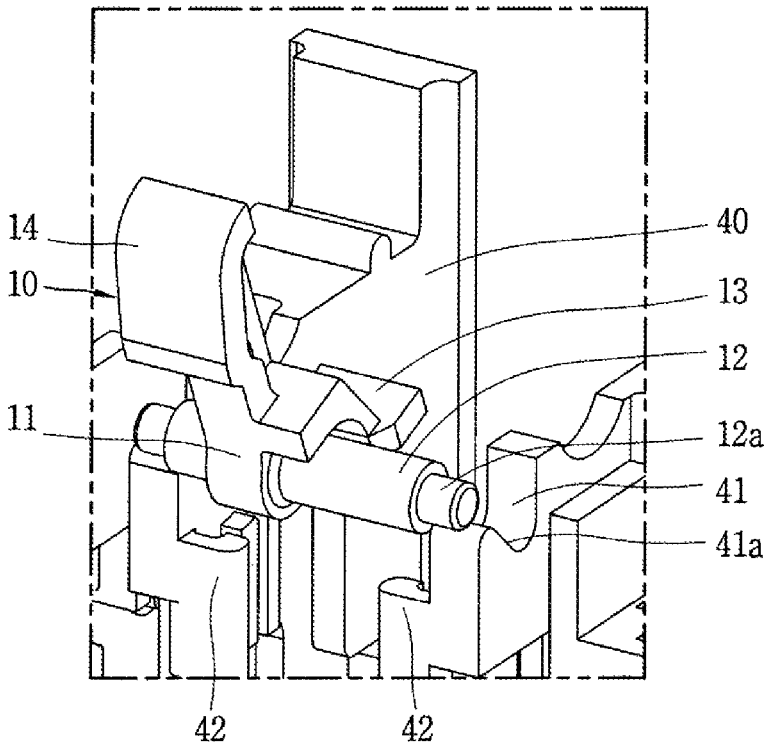
FIGS. 6*a* and 6*b* are views illustrating a process of assembling the shooter with a trip device case, in the trip device of the molded case circuit breaker according to an embodiment of the present invention (for convenience of understanding, the double torsion spring is not illustrated)
Figure 6B:
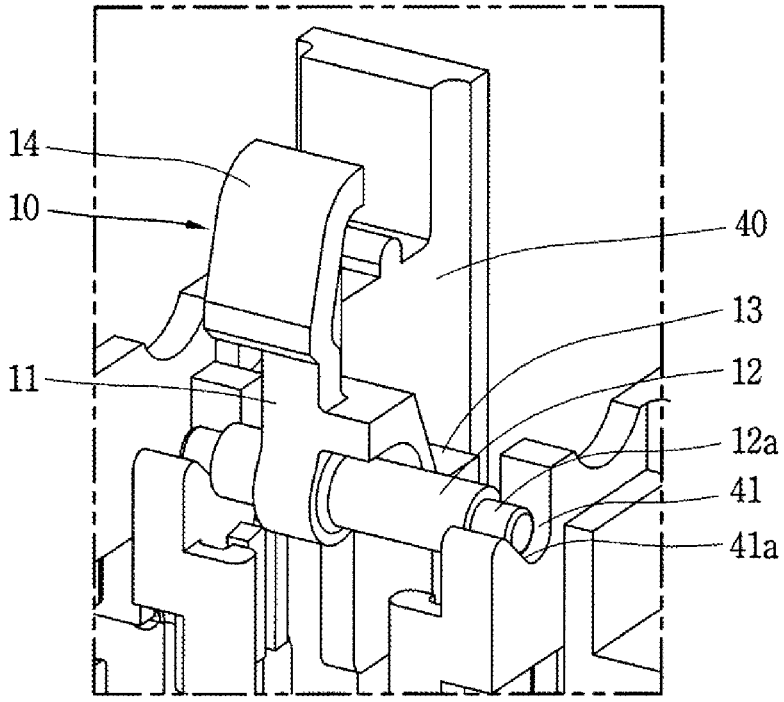

FIG. 3 is a perspective view of a trip device of a molded case circuit breaker according to an embodiment of the present invention. FIG. 4 is a partial detailed view of FIG. 3. FIGS. 5*a*, 5*b* and 5*c* are views illustrating a process of assembling a shooter and a double torsion spring, in the trip device of the molded case circuit breaker according to an embodiment of the present invention. FIGS. 5*a* and 5*b* are views illustrating a process of assembling the shooter with a trip device case, in the trip device of the molded case circuit breaker according to an embodiment of the present invention. Hereinafter, embodiments of the present invention will be described in detail with reference to the accompanying drawings.

A trip device of a molded case circuit breaker according to an embodiment of the present invention includes: a shooter 10 configured to include a body 11 and a rotating shaft 12 which passes through the body 11, wherein a hanging plate 13 is provided at a lower portion of the body 11, and a hitting plate 14 is provided at an upper portion of the body 11; a double torsion spring 20 coupled to both sides of the rotating shaft 12, and configured to provide an elastic restoring force to enable the shooter 10 to rotate; and a crossbar 30 configured to include a hanger 31 that contacts the hanging plate 13 and limits a movement of the shooter 10.

The shooter 10 may be configured with the body 11 and the rotating shaft 12. When seen from a side, the body 11 may be formed in a L-shape (see FIG. 7*a*).

The hanging plate 13 is provided at the lower portion of the body 11. When the hanging plate 13 is fixed in contact with a below-described crossbar 30, a movement of the shooter 10 is limited. When a movement of the hanging plate 13 is free, it is possible for the shooter 10 to move.

An asymmetric groove 15 with one portion opened is formed at one side of the lower portion of the body 11.

The hitting plate 14 is provided at the upper portion of the body 11. The hitting plate 14 hits a nail (not shown) when the body 11 rotates in a trip operation.

The rotating shaft 12 is fixedly coupled to the lower portion of the body 11 to pass through the lower portion of the body 11. That is, the rotating shaft 12 is provided at the lower portion of the body 11 to protrude in both directions. According to an embodiment, the rotating shaft 12 may be provided as one body with the body 11. Both sides of the rotating shaft 12 are asymmetrically formed. That is, in a length by which the rotating shaft 12 protrudes from the body 11, one side of the rotating shaft 12 is formed longer than the other side. Here, the one side of the rotating shaft 12 which is long formed is a side in which the asymmetric groove 15 is formed at the body 11. This is for increasing a degree of free in design in order for the double torsion spring 20 to be easily assembled.

A plurality of coupling parts 12*a* are respectively provided at both ends of the rotating shaft 12, and have a less diameter than a diameter of a central portion of rotating shaft 12. Therefore, the coupling part 12*a* is easily disposed at an receiving part 41 of a below-described trip device case 40, and is fixed so as not to move in an axial direction.

The receiving part 41, to which the shooter 10 is coupled, is provided at a portion of the trip device case 40. The receiving part 41 is formed in a groove shape with an upper portion opened. Therefore, the coupling part 12*a* of the rotating shaft 12 is easily inserted into and coupled to the shooter 10. In order to further increase couplability, a partial surface of the receiving part 41 may be an inclined surface 41*a*.

In the trip device case 40, a supporting plate 42 is provided to protrude at the lower portion of the trip device case 40 and at one side of the receiving part 41. The supporting plate 42 supports the double torsion spring 20.

The hanger 31 is provided to protrude under the crossbar 30. When seen in a horizontal direction, the hanger 31 is provided at a position corresponding to the hanging plate 13. The hanger 31 is formed in a stair type, and includes a first hanging part 32, which is provided at a lower end of the hanger 31, and a second hanging part 33 which is provided at an upper end of the first hanging part 32. Under a normal state, the hanging plate 13 of the shooter 10 is fixed in contact with the first hanging part 32 of the crossbar 30. When the crossbar 30 rotates due to a fault current like a trip operation, the hanging plate 13 of the shooter 10 deviates from the first hanging part 32 of the crossbar 30, and thus, the shooter 10 is rotatable. However, a rotatable range of the shooter 10 is limited by the second hanging part 33. That is, the hanging plate 13 of the shooter 10 contacts the second hanging part 33 of the crossbar 30, and thus, the movement of the shooter 10 is stopped.

The double torsion spring 20 is coupled to both sides of the rotating shaft 12, and provides an elastic restoring force that enables the shooter 10 to rotate. Since the double torsion spring 20 is coupled to both sides of the rotating shaft 12, the double torsion spring 20 enables the shooter 10 to stably rotate. Therefore, force partialized to one side is not applied to the shooter 10, or although a partialized force is applied to the shooter 10, the shooter 10 stably operates because a deviation of force is small.

A consistent force is applied to the shooter 10 by the double torsion spring 20, and thus, the shooter 10 rotates along the rotating shaft 12. Both ends 21 of the double torsion spring 20 are fixed to a portion of the trip device case 40, and a central portion 22 of the double torsion spring 20 is hanged on a lower portion of the hanging plate 13 of the shooter 10, whereby an elastic force is stored. The double torsion spring 20 may be stably mounted on the lower portion of the hanging plate 13 of the shooter 10, and thus, a spring inserting groove 13*a* may be formed in a widthwise direction so as to receive an elastic force. As described above, the both ends 21 of the double torsion spring 20 may be hanged on and supported by the supporting plate 42 of the trip device case 40.

The shooter 10 may vertically stand in a normal state, and in a trip operation, the hanging plate 13 may be detached from the first hanging part 32 according to rotation of the crossbar 30. Therefore, the shooter 10 counterclockwise rotates with an elastic restoring force accumulated in the double torsion spring 20.

A process of assembling the double torsion spring 20 with the shooter 10 will be described in detail with reference to FIGS. 5*a*, 5*b* and 5*c*.

A right hole of the double torsion spring 20 may be fitted into one side (a side which long protrudes among both sides) of the rotating shaft 12 (FIG. 5*a*). At this time, the central portion 22 of the double torsion spring 20 may be downward oriented. The double torsion spring 20 may be put in the asymmetric groove 15 of the shooter 10. In this case, the central portion 22 may pass through an open portion of the asymmetric groove 15, and thus, interference does not occur. A left hole of the double torsion spring 20 may be fitted into the other side of the rotating shaft 12 (FIG. 5*b*). The left hole of the double torsion spring 20 may be put in a central side (FIG. 5*c*). In this case, the right hole of the double torsion spring 20 may deviate from the asymmetric groove 15, and thus, interference does not occur when the both ends 21 rotate.

FIG. 7 is an operational view of the trip device of the molded case circuit breaker according to an embodiment of the present invention when seen from a side.

Figure 7A:
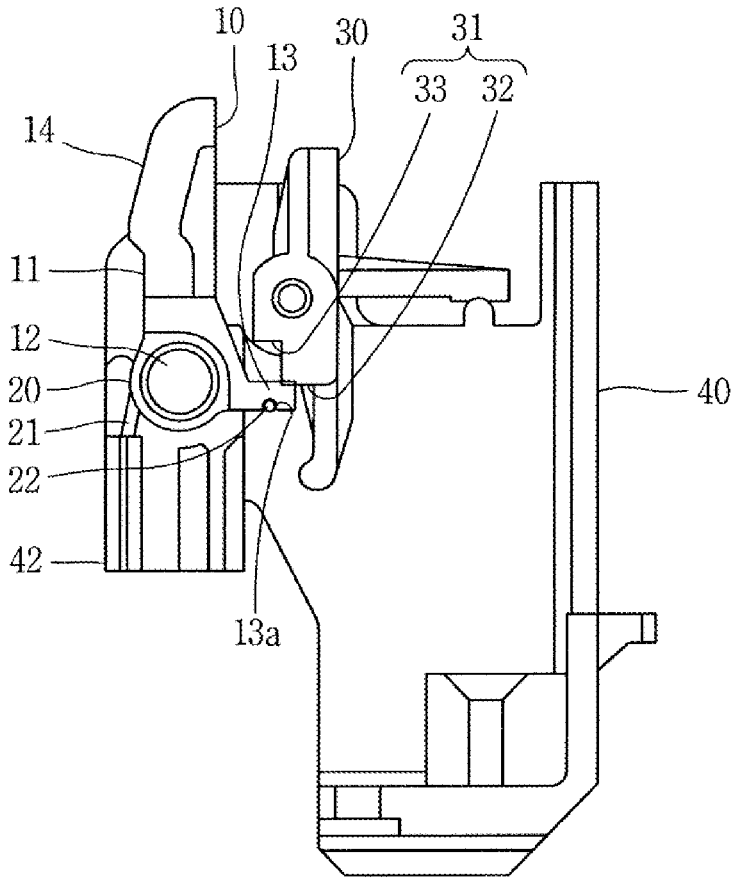
FIGS. 7*a* and 7*b* are operational views of the trip device of the molded case circuit breaker according to an embodiment of the present invention when seen from a side.
Figure 7B:
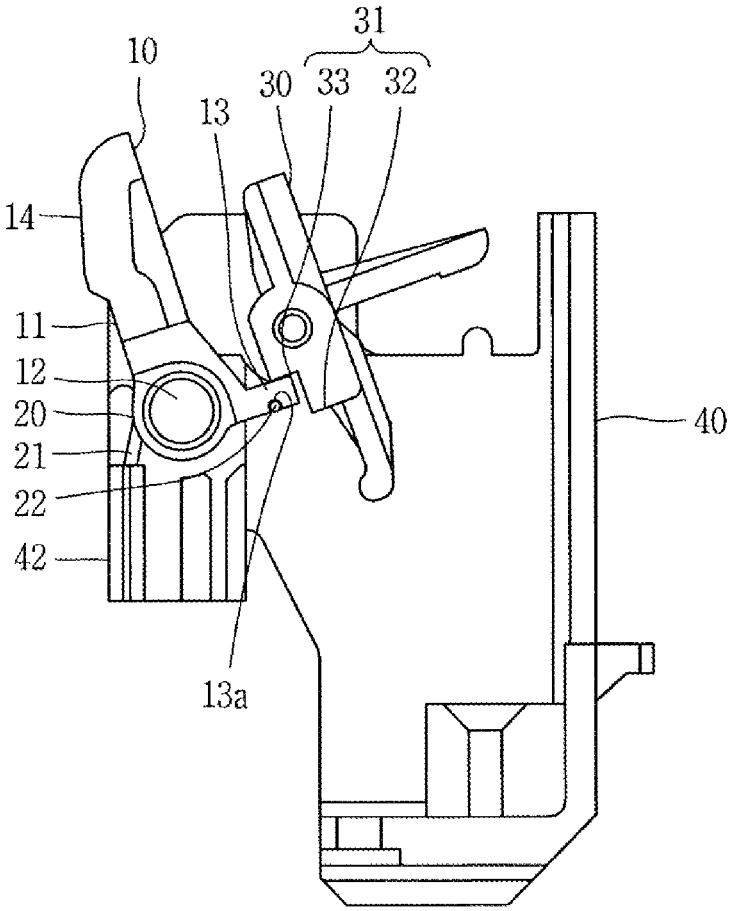

In a normal state, the shooter 10 and the crossbar 30 is in a vertical state(FIG. 7*a*). At this time, the hanging plate 13 of the shooter 10 is hanged on the first hanging part 32 of the crossbar 30. When the crossbar 30 counterclockwise rotates due to a trip operation caused by a fault current, the hanging plate 13 is detached from the first hanging part 32. The shooter 10 counterclockwise rotates with the elastic restoring force of the double torsion spring 20, and the hitting plate 14 hits the nail (not shown) to detach a moving contact from a fixed contact. Also, the hanging plate 13 of the shooter 10 contacts the second hanging part 33 of the crossbar 30 to stop rotation (FIG. 7*b*).

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A trip device of a molded case circuit breaker, the trip device comprising:

a shooter configured to include a body and a rotating shaft which passes through the body, wherein a hanging plate is provided at a lower portion of the body, and a hitting plate is provided at an upper portion of the body;

a double torsion spring coupled to both sides of the rotating shaft, and configured to provide an elastic restoring force to enable the shooter to rotate; and a crossbar configured to include a hanger that contacts the hanging plate and limits a movement of the shooter, wherein the hanger is formed in a stair type, and comprises a first hanging part and a second hanging part, wherein under a normal state, the hanging plate of the shooter is fixed in contact with the first hanging part of the crossbar, and during a trip operation a rotatable range of the shooter is limited by the second hanging part.

2. The trip device of claim 1, wherein the rotating shaft is inserted into a receiving part of a trip device case, and an upper portion of the receiving part of the trip device case is open.

3. The trip device of claim 2, wherein a portion of the receiving part of the trip device case has an inclined surface.

4. The trip device of claim 1, wherein one side of the rotating shaft is formed longer than the other side of the rotating shaft.

5. The trip device of claim 1, wherein a plurality of coupling parts are respectively provided at both ends of the rotating shaft, and have a smaller diameter than a diameter of a central portion of rotating shaft.

6. The trip device of claim 1, wherein an asymmetric groove is formed at one side of a lower portion of the body.

* * * * *